US007275655B2

(12) United States Patent
Duff

(10) Patent No.: US 7,275,655 B2
(45) Date of Patent: Oct. 2, 2007

(54) CENTER PULL TISSUE DISPENSER AND RELATED MECHANISM

(75) Inventor: Kenneth Stuart Duff, Blenheim (NZ)

(73) Assignee: Durolla Products (NZ) Limited, Auckland (NZ)

( * ) Notice: Subject to any disclaimer, the term of this patent is extended or adjusted under 35 U.S.C. 154(b) by 49 days.

(21) Appl. No.: 10/779,316

(22) Filed: Feb. 17, 2004

(65) Prior Publication Data

US 2005/0067424 A1 Mar. 31, 2005

Related U.S. Application Data

(63) Continuation-in-part of application No. 10/673,923, filed on Sep. 30, 2003.

(51) Int. Cl.
*B65H 1/00* (2006.01)

(52) U.S. Cl. ..... 221/41; 221/62

(58) Field of Classification Search ..... None
See application file for complete search history.

(56) References Cited

U.S. PATENT DOCUMENTS 6,592,001 B2 * 7/2003 Lewis et al. ..... 221/33
6,769,589 B2 * 8/2004 Paukov ..... 225/106
6,869,041 B1 * 3/2005 Allegre et al. ..... 242/593

* cited by examiner

*Primary Examiner*—Gene O. Crawford
*Assistant Examiner*—Timothy Waggoner
(74) *Attorney, Agent, or Firm*—Jacobson Holman PLLC

(57) ABSTRACT

A center pull tissue dispenser having an openable enclosure, and a base member located within the enclosure to support a coreless roll of towel material. The end face of the roll is placed on the same base member, and an opening in a wall of the openable enclosure defining member allows dispensing of the towel material. Downstream of the support of the roll by the base there is provided a dispensing adjustment mechanism. This includes, a passageway through which the towel can pass, and a passageway restriction controlling member that is movable relative to the passageway.

22 Claims, 16 Drawing Sheets

CENTER PULL TISSUE DISPENSER AND RELATED MECHANISM

This is a continuation-in-part of U.S. Ser. No. 10/673,923 filed Sep. 30, 2003.

FIELD OF INVENTION

The present invention relates to a centre pull tissue dispenser and a related mechanism for controlling the feed characteristics thereof.

BACKGROUND

With the advent of paper companies supplying tissue such as paper towels, toilet paper and the like in the form where there is no separate core provided (such as a cardboard core) developments have been occurring in relation to devices for convenient dispensing of the tissue material from the roll.

The dispensing of tissue material from a coreless roll can occur from both the perimeter thereof or from the centre of the coreless roll.

Several manufacturers exist which provide paper tissue in the form of coreless rolls and each manufacturer provides tissue material of different qualities, grades and gauges. For such different materials, different characteristics of strength and tearability exist. There is hence a need for a dispenser with a mechanism which allows for such variation in characteristics to be taken into consideration and allow for an adjustment to occur to ensure that convenient dispensing of the tissue material is achieved regardless of the characteristics of the material.

BRIEF DESCRIPTION OF THE INVENTION

Accordingly it is an object of the present invention to provide a centre pull tissue dispensing apparatus and/or mechanism for adjusting the dispensing characteristics of a towel dispensing apparatus which takes into consideration the abovementioned desiderata or which will at least provide the public with a useful choice.

Accordingly the present invention consists in a center pull tissue dispenser comprising or including, means defining an openable enclosure, a base member located within said enclosure with which a coreless roll of towel material is to be located in an upward supporting manner in a manner such that an end face of said roll is placed therewith, said base member including a dispensing opening for said towel material to pass through wherein an opening is provided in alignment with said dispensing opening, through said openable enclosure defining member, to allow said towel material to be dispensed from said dispenser wherein downstream of the support of said roll by said base member there is provided a dispensing characteristic adjustment mechanism which includes, a passageway through which said towel material is to pass, and a passageway restriction controlling member, movable relative to said passageway in a direction lateral to the direction of the passing of said paper towel material there through and penetrating into the passageway to act on said paper towel material during the dispensing thereof from said dispenser.

In a second aspect the present invention consists in a mechanism to control the dispensing characteristics of a towel from a dispenser comprising:

a base member to be placed inside a dispenser for receiving thereon or therewith a coreless roll of towel in a manner such that an axial end face of said roll is placed thereagainst, wherein downstream of the support of said roll by said base member there is provided a dispensing characteristic adjustment mechanism which includes, a passageway through which said towel material is to pass, and a passageway restriction controlling member movable relative to said passageway in a direction lateral to the direction of the passing of said paper towel material there through and penetrating into the passageway to act on said paper towel material during the dispensing thereof from said dispenser.

Preferably said passageway restriction controlling member is mounted on a carrier relative to which it is movable to variably restrict the passing of paper towel material through said passageway.

Preferably said carrier is itself movable and when moved, said restriction controlling member displaces in unity there with.

Preferably when said carrier is moved, the restriction of said passageway is changed.

Preferably said restriction controlling member can be moved entirely out of said passageway.

Preferably said restriction controlling member is moveable relative to said carrier by being in a sliding engagement with said carrier.

Preferably said sliding engagement is controlled by a spindle rotatable about an axis transverse to the direction of sliding engagement and having a lug off-set from said axis, mechanically coupled with said restriction controlling member to displace said restriction controlling member relative to said carrier.

Preferably wherein said passageway restriction controlling member is adjustable in its positioning relative to said passageway from outside of said openable enclosure.

Preferably said passageway restriction controlling member is adjustable by a key which is insertable into a keyhole to operate a mechanism to displace the passageway restriction controlling member relative to said passageway.

Preferably the restriction controlling member is moveable relative to said passageway and urged toward a passage way restricting condition by a biasing means to restrict said passageway.

Preferably said carrier is manually movable by operation of a handle which controls a carrier movement actuator mechanism.

Preferably a funnel member is provided below the support surface of said base member to funnel and guide towel material in a continuous manner from the coreless roll towards said opening in a openable enclosure.

Preferably said towel is to be dispensed from the center outwardly of said coreless roll.

Preferably said dispensing characteristic adjustment mechanism is provided downstream of said support surface of said base, and within said enclosure of the dispenser.

Preferably said openable enclosure is openable in a manner to allow access to said base member.

Preferably said openable enclosure consists of a back wall mountable portion for mounting to a substantially vertical surface of a structure, and a cover moveable relative thereto.

Preferably said cover is pivotally moveable relative to said back wall mountable portion.

Preferably said openable enclosure consist of a first cover member pivotally located with a second cover member movable relative to each other between an open condition wherein said interior of said openable enclosure is exposed and a closed condition wherein said interior is closed, said dispensing characteristic adjustment mechanism actuated by the movement of said first cover member with said second cover member by an actuator in mechanical engagement with a said first or second cover member and coupled to said passageway restriction controlling member to move it from a first position relative to said passage way when the enclosure is in said open condition to a passageway restricting more condition when said enclosure in said closed condition.

Preferably said passageway restriction controlling member is mounted on a carrier relative to which it is movable to variably restrict the passing of paper towel material through said passageway and said openable enclosure consist of a first cover member pivotally located with a second cover member movable relative to each other between an open condition wherein said interior of said openable enclosure is exposed and a closed condition wherein said interior is closed, said dispensing characteristic adjustment mechanism actuated by the movement of said first cover member with said second cover member by an actuator in mechanical engagement with a said first or second cover member and coupled to said carrier to move it from a first position relative to said passage way when the enclosure is in said open condition to a second condition when said enclosure in said closed condition wherein the passageway restriction controlling member is in a passageway restricting more condition.

Preferably wherein said actuator moves said carrier between two conditions, wherein in one such condition, corresponding to the enclosure being in a closed condition, placing said passageway restriction controlling member in said passageway, wherein said passageway restriction controlling member is slidably disposed from said carrier in a direction lateral to said passageway direction, a biasing means acting on said passageway restriction controlling member from said carrier to urge said passageway restriction controlling member to a passageway restricting more condition yet allowing the displacement of said passageway restriction controlling member in a direction opposite thereto against the biasing force.

Preferably said first cover member and said second cover member are pivotally engaged about a pivot axis extending lateral to the passageway direction.

Preferably said pivot axis is provided such that the second cover moves downwardly to said first cover in moving from the second condition to the first condition.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

BRIEF DESCRIPTION OF THE DRAWINGS

One preferred form of the present invention will now be described with reference to the accompanying drawings in which.

DETAILED DESCRIPTION OF THE INVENTION

Where herein reference is made to a tissue, it is to be interpreted in a broad sense to include for example tissue, toilet paper, paper towels, whether of a single or multiply material and any other of such like materials. Such are provided in the form of a solid core roll and are to be dispensed therefrom from the centre outwardly. The roll may have perforations provided to define frangibly detachable portions of tissue or may alternatively be substantially non perforated.

Figure 12:
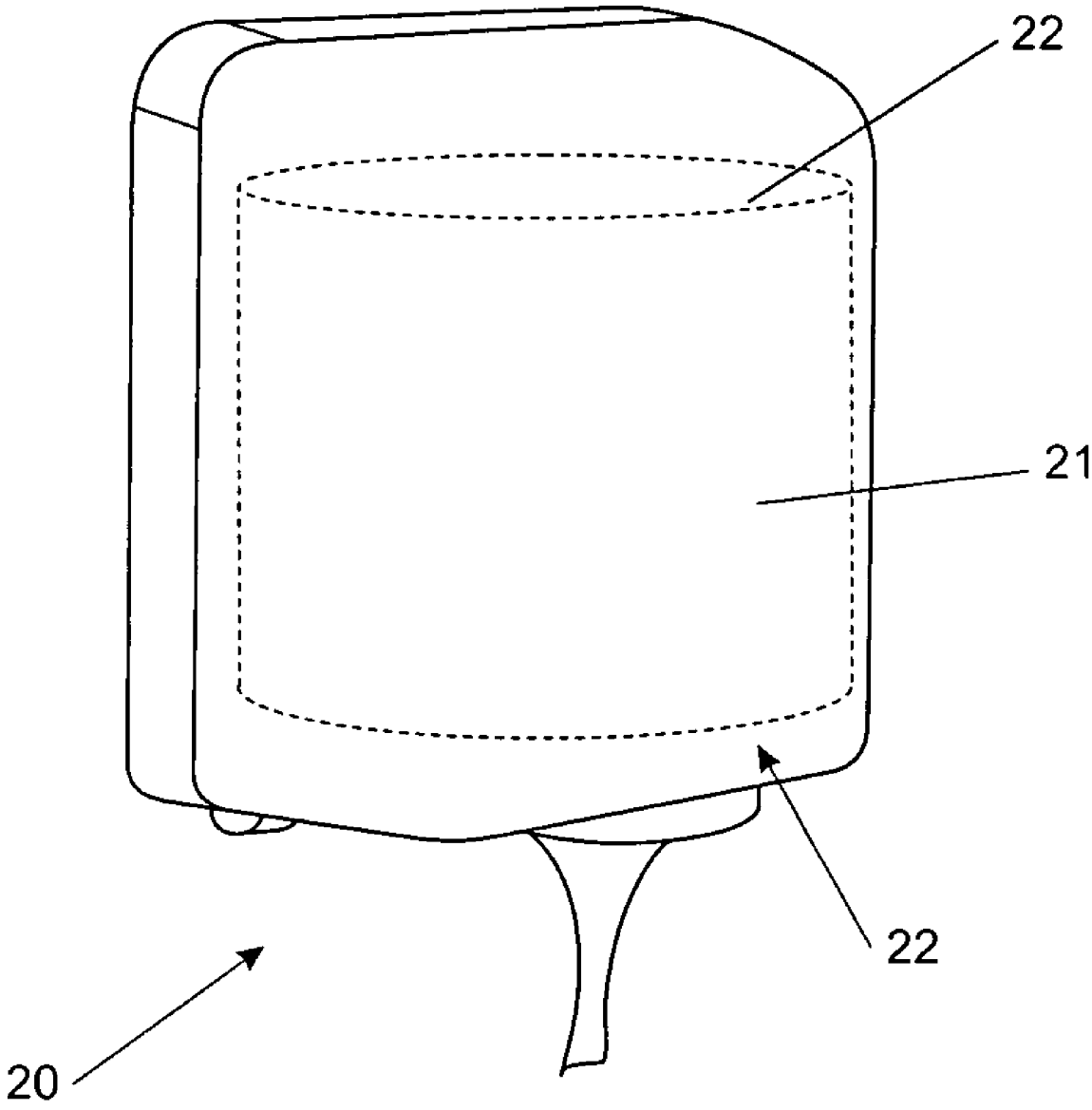
FIG. 12 is a perspective view of the exterior of a tissue dispensing apparatus of the present invention, mounted in a vertical orientation.

With reference to FIG. 12 there is shown a dispenser of a kind to which the present invention relates. The dispenser provides an openable enclosure 20 within which a coreless role of, for example, a tissue paper is to be positioned. The dispenser 20 is preferably for example arranged so that the tissue paper can dispense through the bottom of the apparatus, as illustrated here, where the dispenser is mounted in a vertical arrangement. However top dispensing or even side dispensing arrangements are examples of alternatives.

The apparatus of the present invention is preferably mountable to a horizontal structure, such as a wall in a toilet. The dispenser of the present invention may however be located in many other locations where tissues or towels are often required.

Within the dispenser of the present invention, the roll of tissue is provided so as to locate against a base (not shown in FIG. 12) wherein one of the axial end faces 22 is located against a base. In the arrangement where the axial end faces of the roll are substantially horizontal, the base member provides the vertical support to the roll.

The base preferably holds the core in a position to allow for the tissue to dispense therefrom. In the preferred form where the base supports the roll, the base is preferably provided towards the lower end of the openable enclosure defining member 20.

Figure 5:
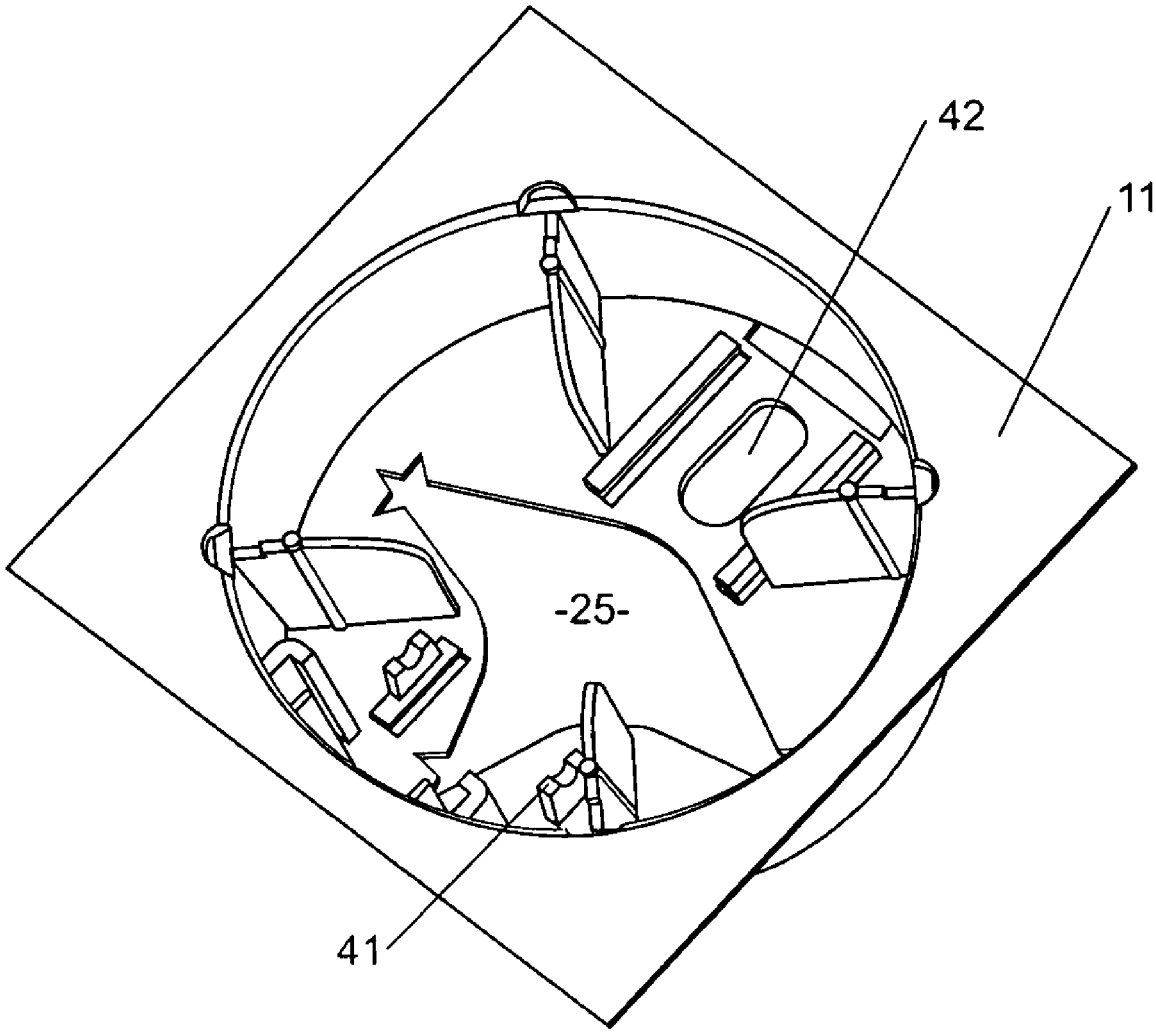
FIG. 5 is a top isometric view of the base 11 with the pinion axle mounts 41 shown for mounting of the carrier pinion, thus the assembly shown in FIG. 2 together with the funnel in FIG. 1 resides within this base, and an aperture 42 is also illustrated that facilitates access to the restriction adjusting mechanism.
Figure 6:
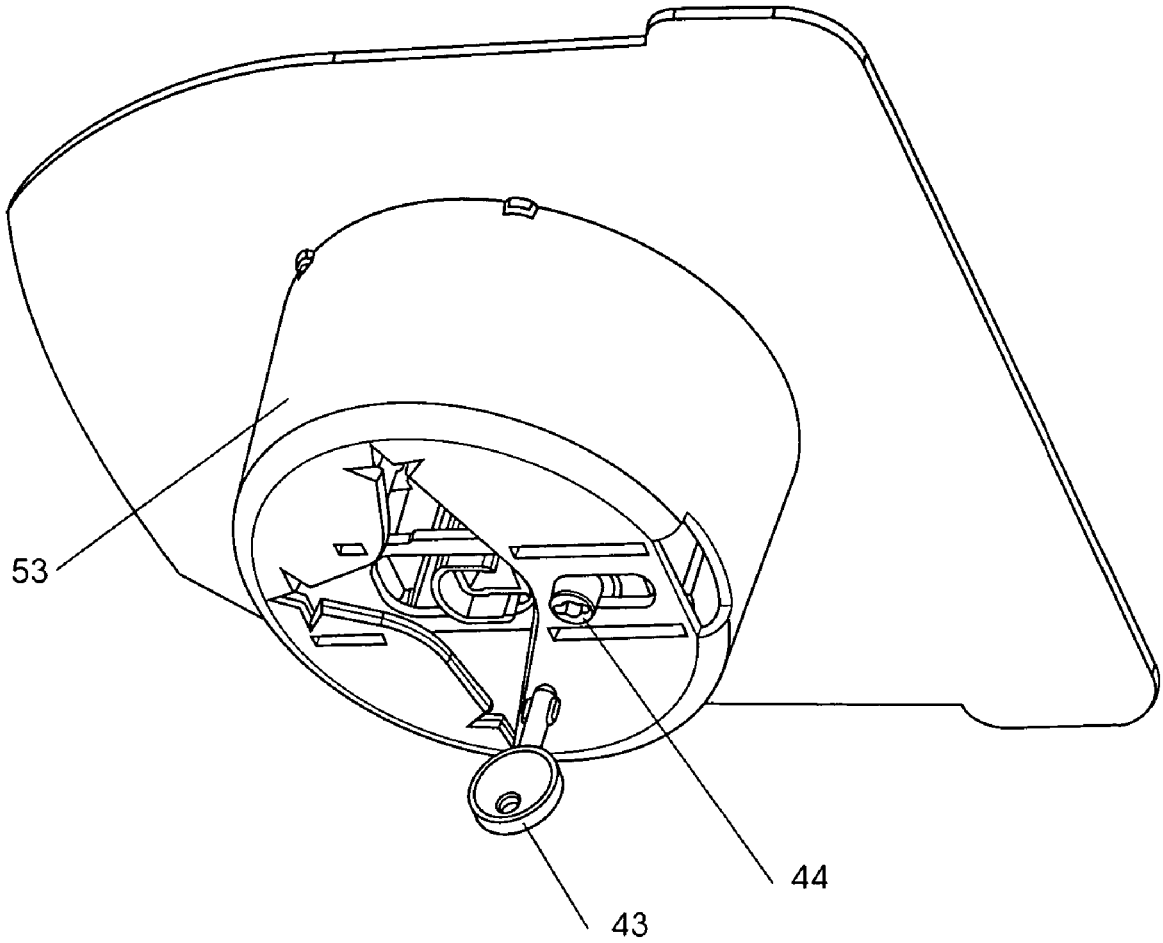
FIG. 6 shows the use of the adjusting key 43 with the restriction adjusting mechanism key hole 44 protruding through the aperture 42 in the base.

FIG. 5 shows a portion of the base 11 of the present invention, the base provides a surface onto which the axial end face of the roll can be placed. Below such support surface there is provided an opening through which the tissue paper, pulled from the centre of the core, can be dispensed. This opening 25 may include perimeter features designed to aid in the perforation or tearing of the tissue paper so that selected and desired lengths and quantities of paper can be removed from the roll. Such perimeter features may have serrated edges.

Figure 1:
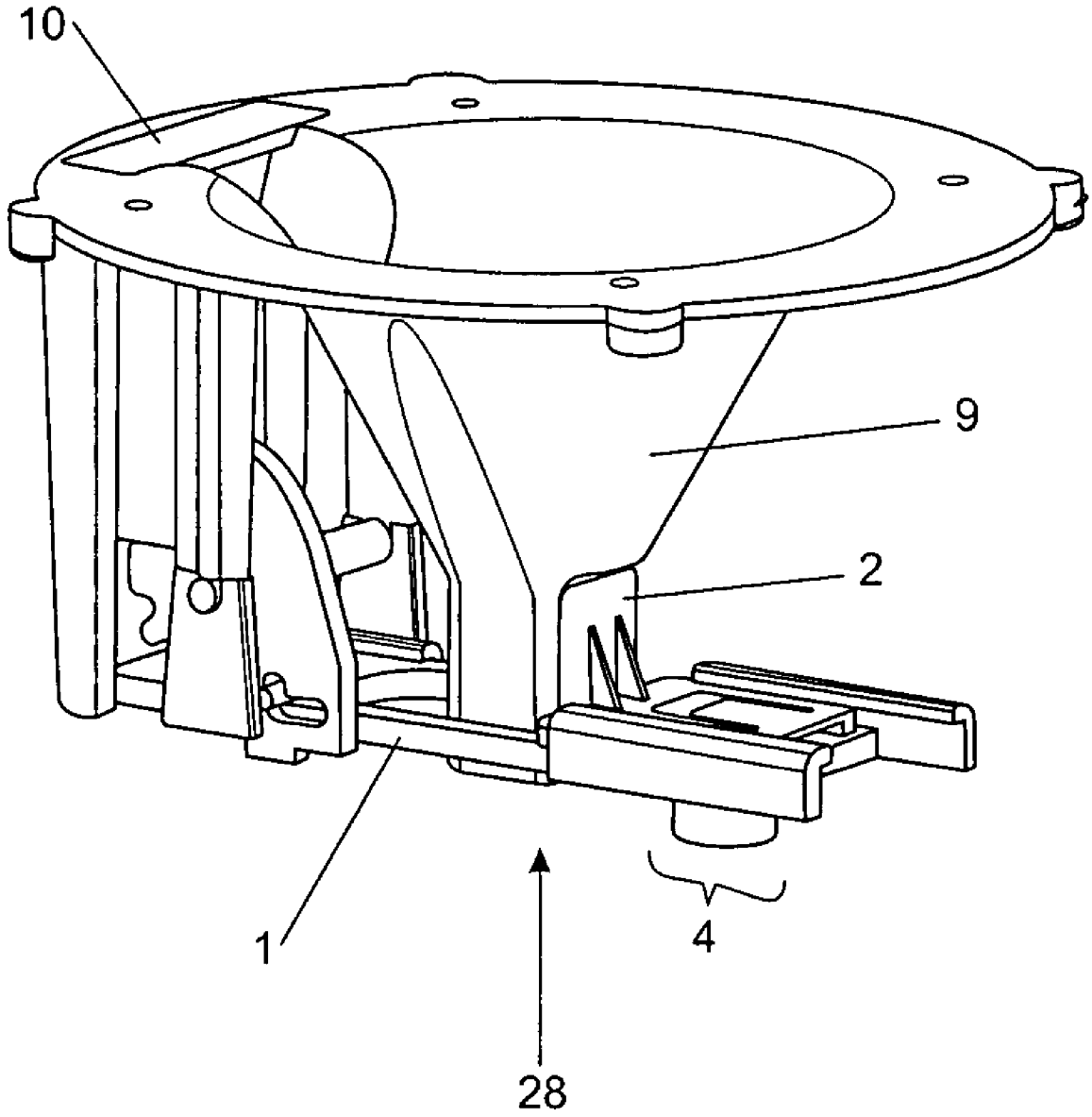
FIG. 1 shows the present invention assembled with the funnel 9, which the paper product enters from above, passes through and exits out the passage 28 indicated.
Figure 2:
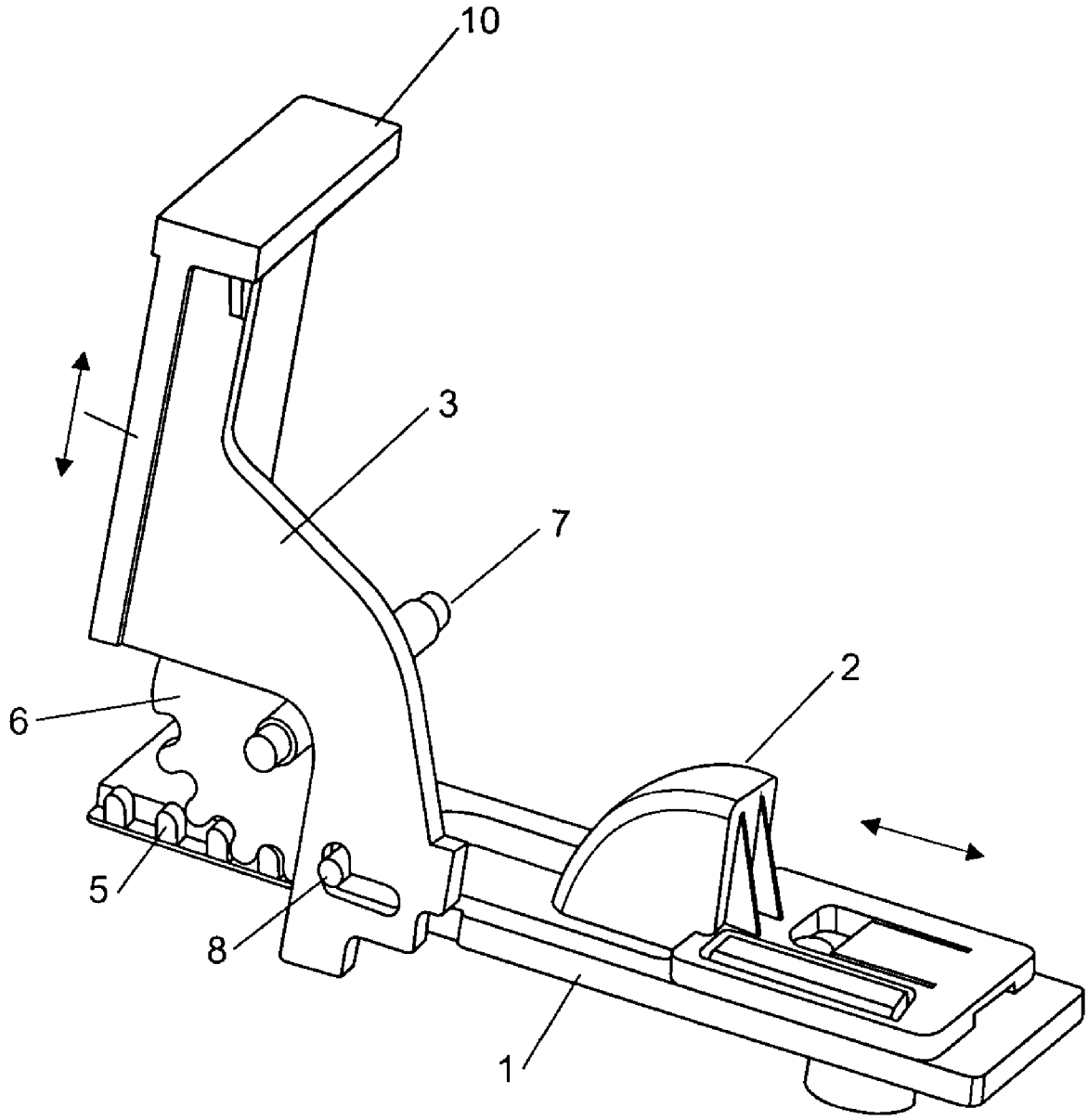
FIG. 2 depicts in detail the mechanism for altering the tension applied to the paper and the means with which to open the throat of the passage fully. An actuator handle 10 urges a carrier actuator 3 to move in a vertical direction to actuate a pinion lug 8 which in turn causes partial rotation of the carrier pinion 6 about the pinion axle 7. The carrier pinion in turn engages with the carrier rack 5 to cause the horizontal movement of the carrier 1 which in turn moves the restriction controller 2. Thus when the actuator handle is lifted the restriction controller is moved clear of the throat of the passage to facilitate easy initiation of the paper product down the funnel and out the passage, and in the lowered position the actuator handle locks the movement of the pinion lug and hence the carrier and introduces the restriction controller to the throat of the passage. In this position the restriction adjusting mechanism 4 may be altered by the use of a key 43 to adjust the restriction controller's intrusion into the passage throat and thus vary the amount of friction applied to the paper product when pulled down through the passage.
Figure 3:
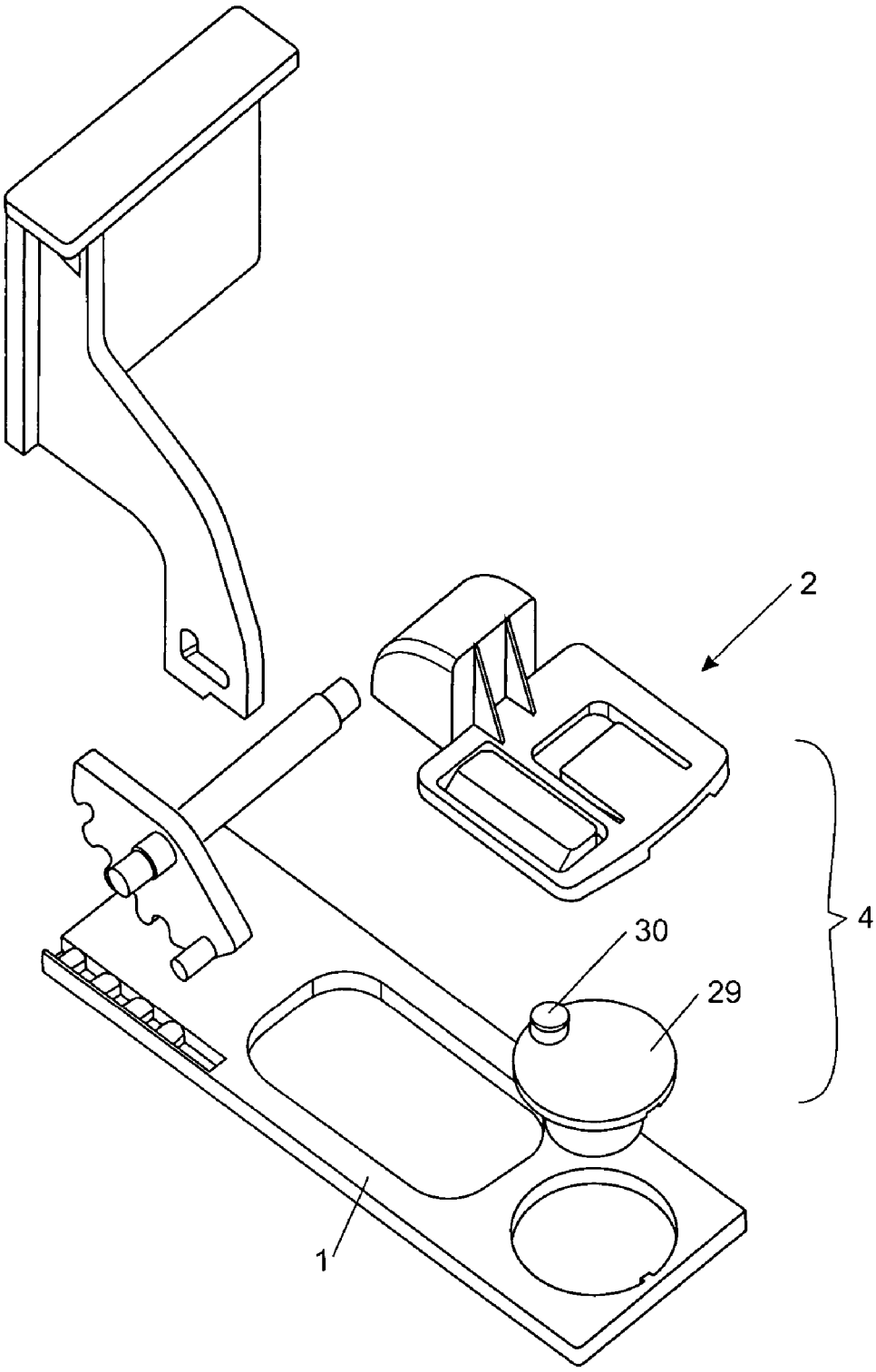
FIG. 3 illustrates an exploded isometric view of the five main components depicted in FIG. 2, in particular can be seen in more detail the restriction adjusting mechanism 4 and its engagement into the carrier 1 and restriction controller 2.
Figure 4:
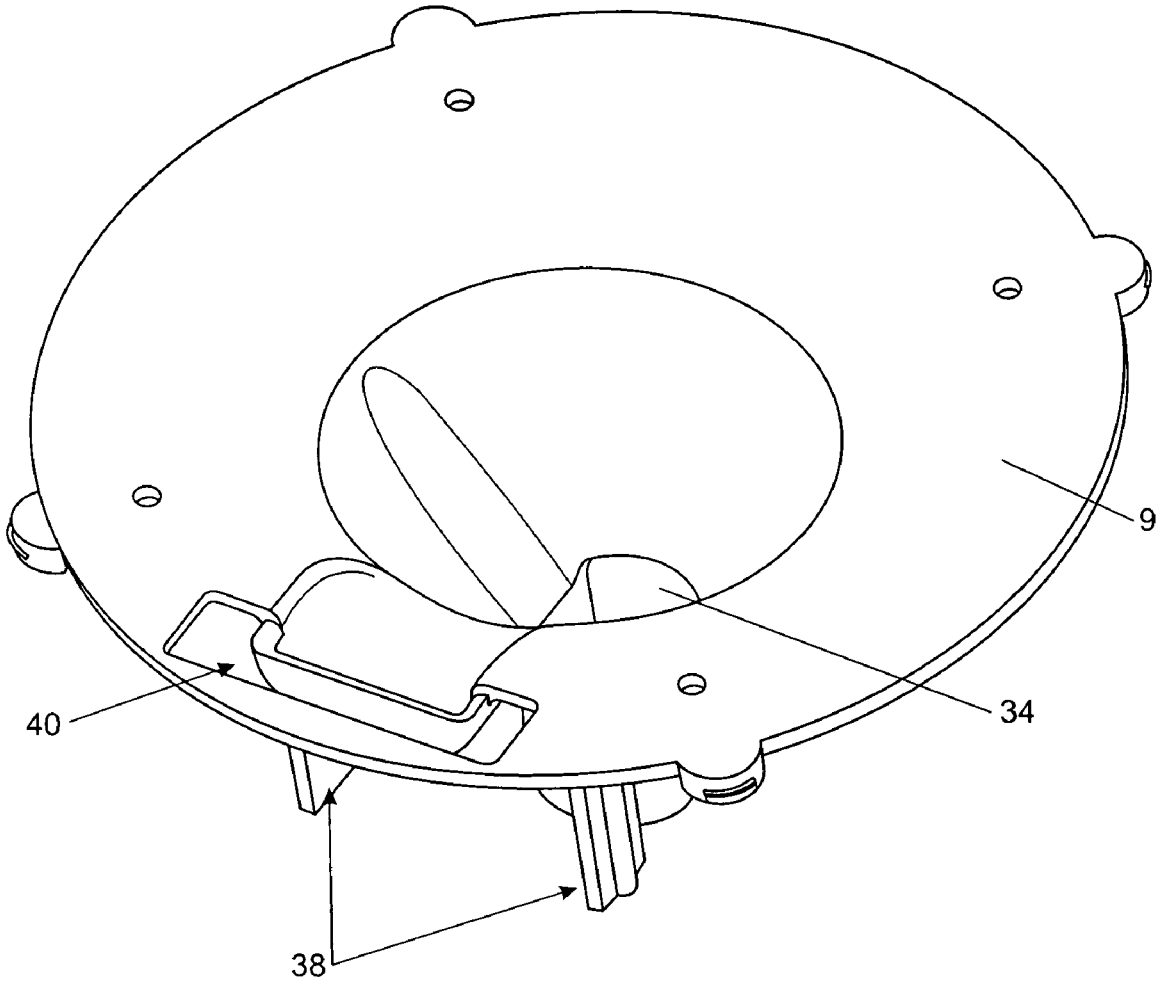
FIG. 4 is a top isometric view clearly showing the funnel member 9 with the location of a recess 40 which allows access to the actuator handle 10 (not shown) to open the throat of the passage, the opening 34 for the restriction controller is also illustrated.
Figure 10:
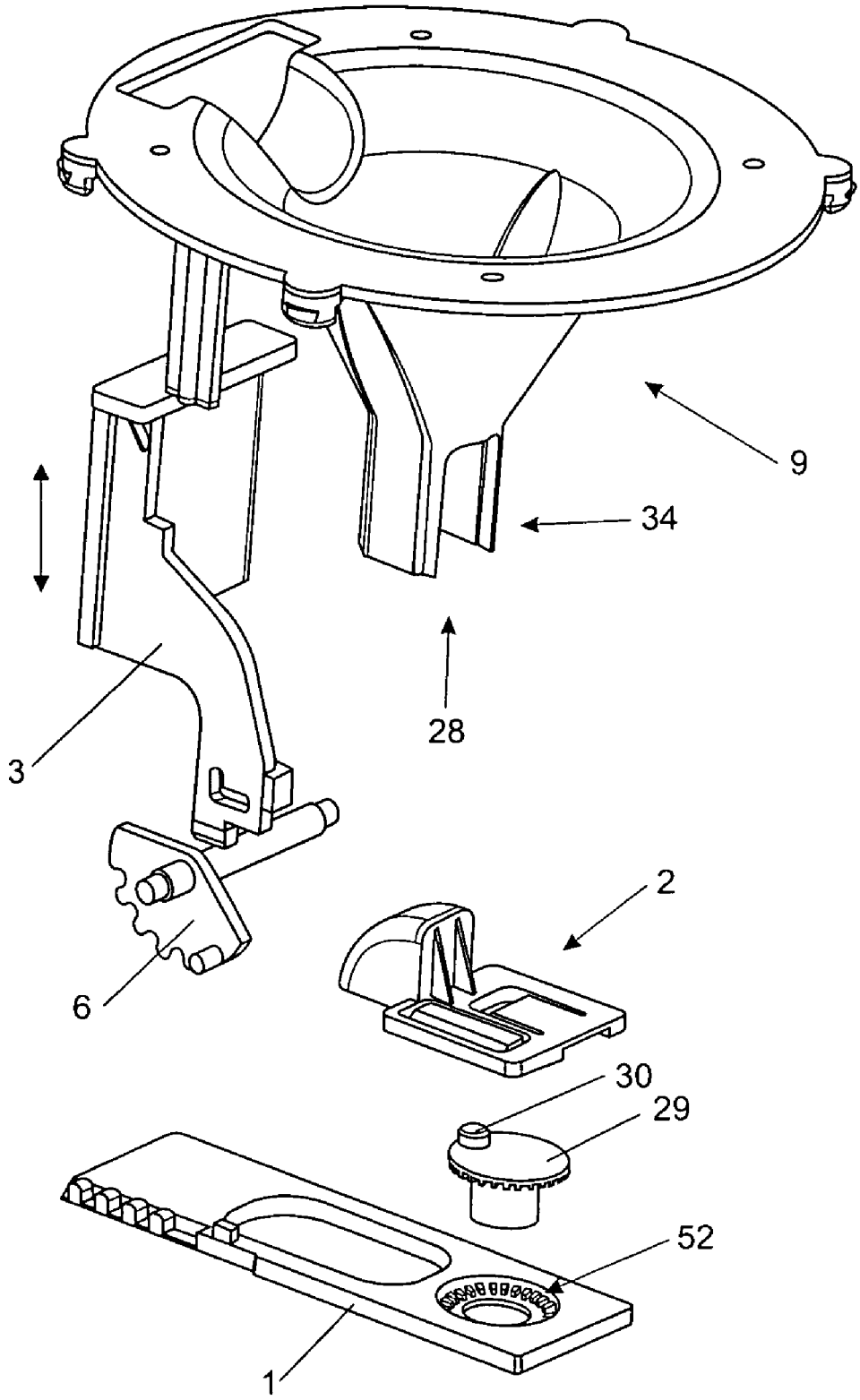
FIG. 10 is an exploded isometric view of the mechanism of the present invention.

Provided intermediate of the support surface of the base and the dispensing opening, there is provided a mechanism to control the dispensing characteristics of the tissue, as illustrated in FIG. 3 and in funnelling surface defining member 9 (as shown in FIG. 4), the assembly of which is shown in FIGS. 2, 1 and 10.

Figure 13:
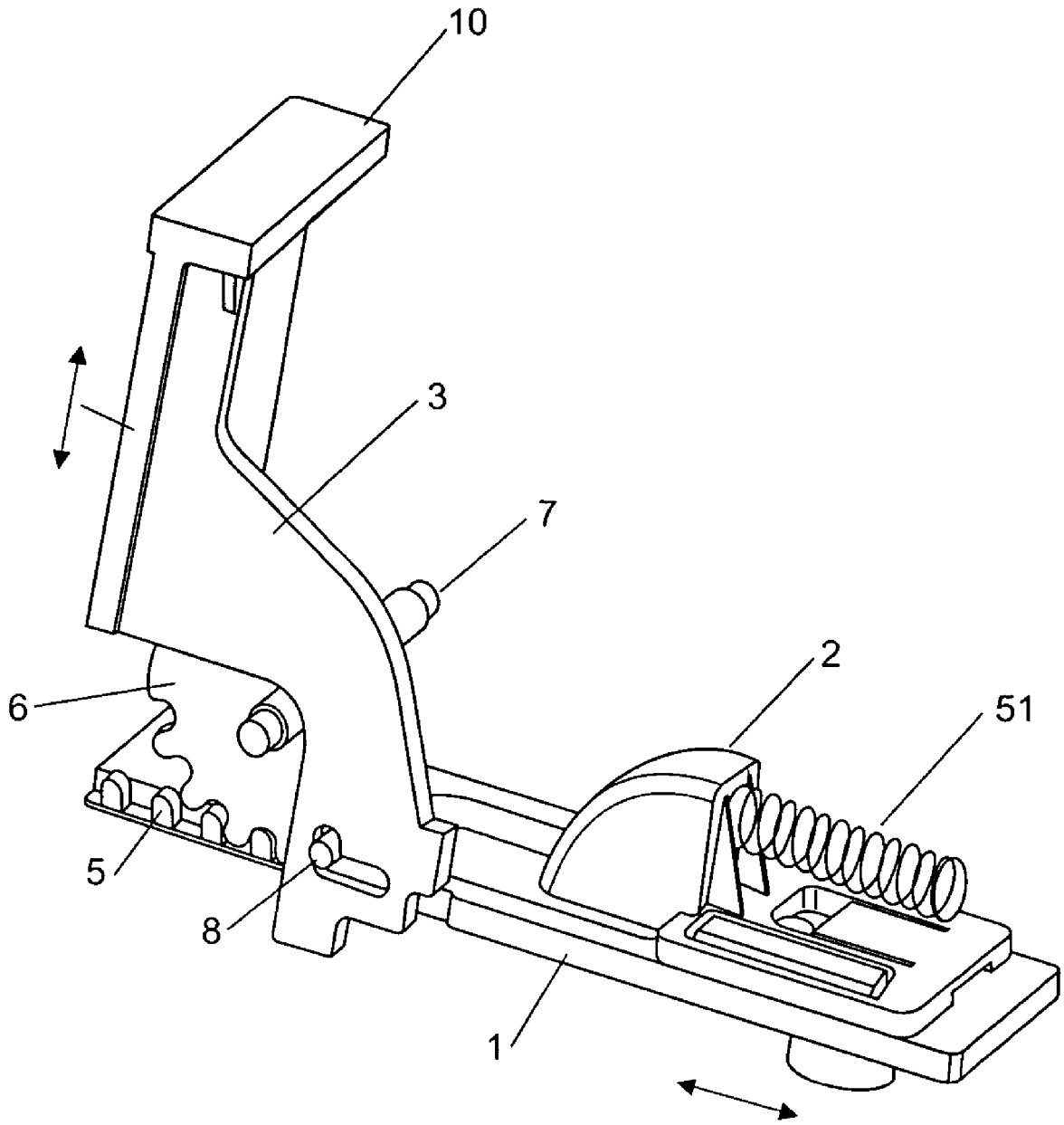
FIG. 13 is a view similar to FIG. 10 of the present invention, with the exception that the restriction controller 2 is biased into the throat of funnel 9 via the opening 34 by means of a spring 51 which bears upon the rear of the restriction controller 2 and the opposite and of the spring bears upon an innerwall of the base 11 (not shown). Thus is achieved a self tensioning system for paper towel dispensing, rather than one that is affected manually by the key system depicted in FIGS. 6 and 9.

Illustrated in FIG. 1 the passage way is preferably defined by a lower region of the funnelling surface defining member 9. Preferably as a throat to the funnel. The passage way 28 is for example a channel section at the lower end of the funnel 9. Relative to this passage way and moving in a direction in and out relative thereto is the restriction controller 2. The restriction controller 2 moves in and out of the passage way and accordingly restricts and unrestricts the passage way thereby having an influence on the degree of ease of which the tissue can be drawn from the centre of the core. In the most preferred form the restriction controller 2 is a member which is of a smooth contoured surface which will prevent the tearing of the tissue as it passes thereover. In the most preferred form the restriction controller 2 moves relative to the passage 28 by a restriction adjusting mechanism 4. An alternative to this arrangement is illustrated in FIG. 13. This mechanism is adapted to slidingly move the restriction controller 2, in and out of the passage 28.

With reference to FIGS. 3 and 10, the mechanism consists of a spindle type arrangement having a rotatable spindle 29 which includes a lug 30 located within a slot of the restriction controller 2. The restriction controller 2 is mounted in a sliding arrangement to slide in and out of the passage 28 and by rotating the spindle 29, a linear displacement of the restriction controller 2 will occur. A notched configuration 52 as shown in FIG. 10 may be provided so that undesired movement of the restriction controller is reduced. In a first configuration of the invention, the spindle 29 is preferably actuable by a user of the device to set the degree of restriction that is desired and required for convenient dispensing of the tissue. Such setting may be required where a new and different tissue is replaced in the dispenser where the tissue has different strength characteristics. Potentially also, as tissue is removed from the roll, a slow variation in the dispensing characteristics may occur requiring the occasional re-adjustment of the restriction controller.

The dispenser of the present invention is adopted to allow for convenient replacement of rolls within the enclosure defining member.

Figure 8:
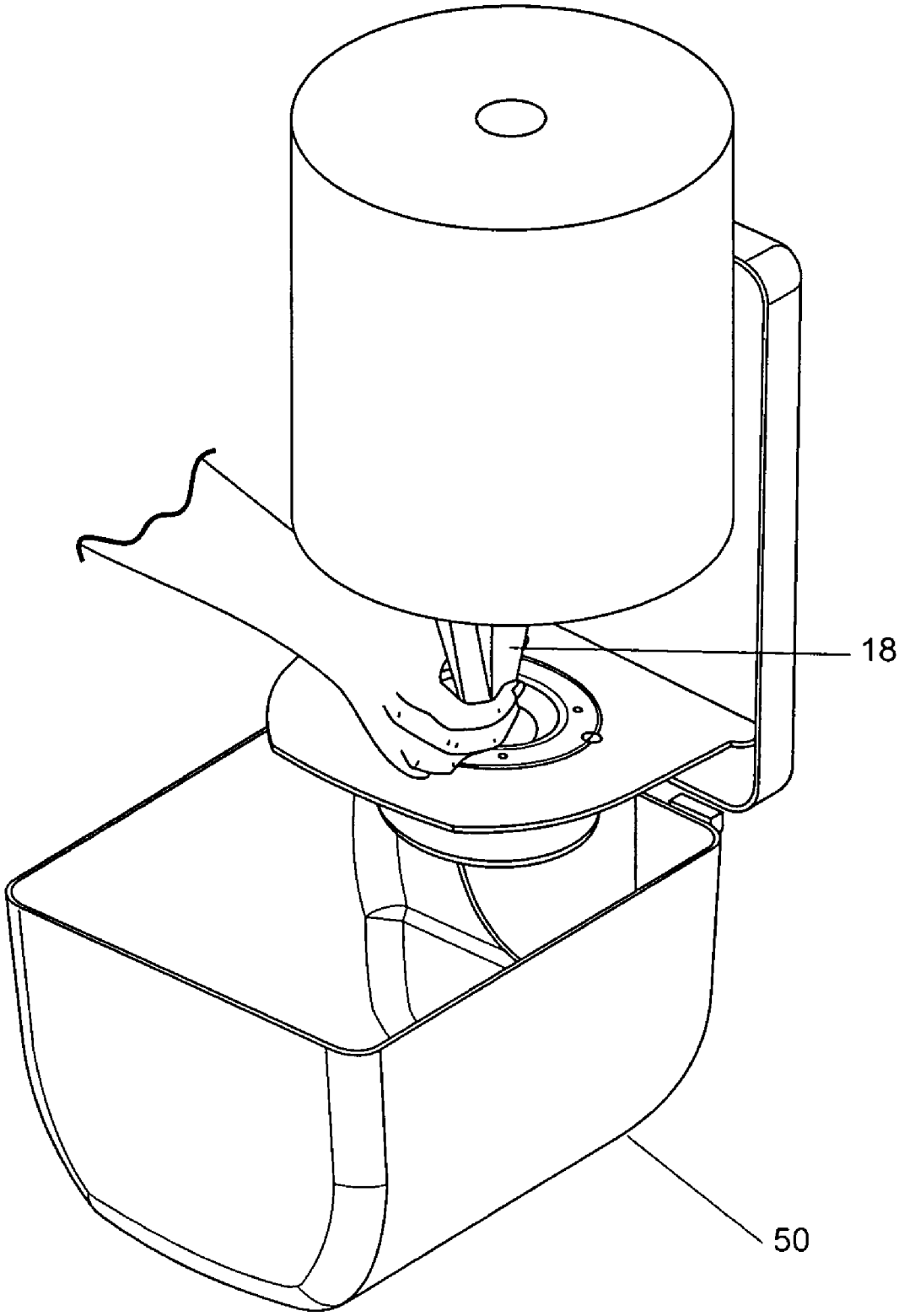

When a new roll is loaded into the device, (as shown in FIG. 8, by the opening of an access cover 50) it is likely that the setting of restriction, where the roll is from the same supplier and of the same characteristics, will remain the same. However as the restriction controller 2, is located potentially with a large degree of restriction to the passage 28, it may be difficult for a feed of the start of the roll to be provided through the passage.

Figure 7:
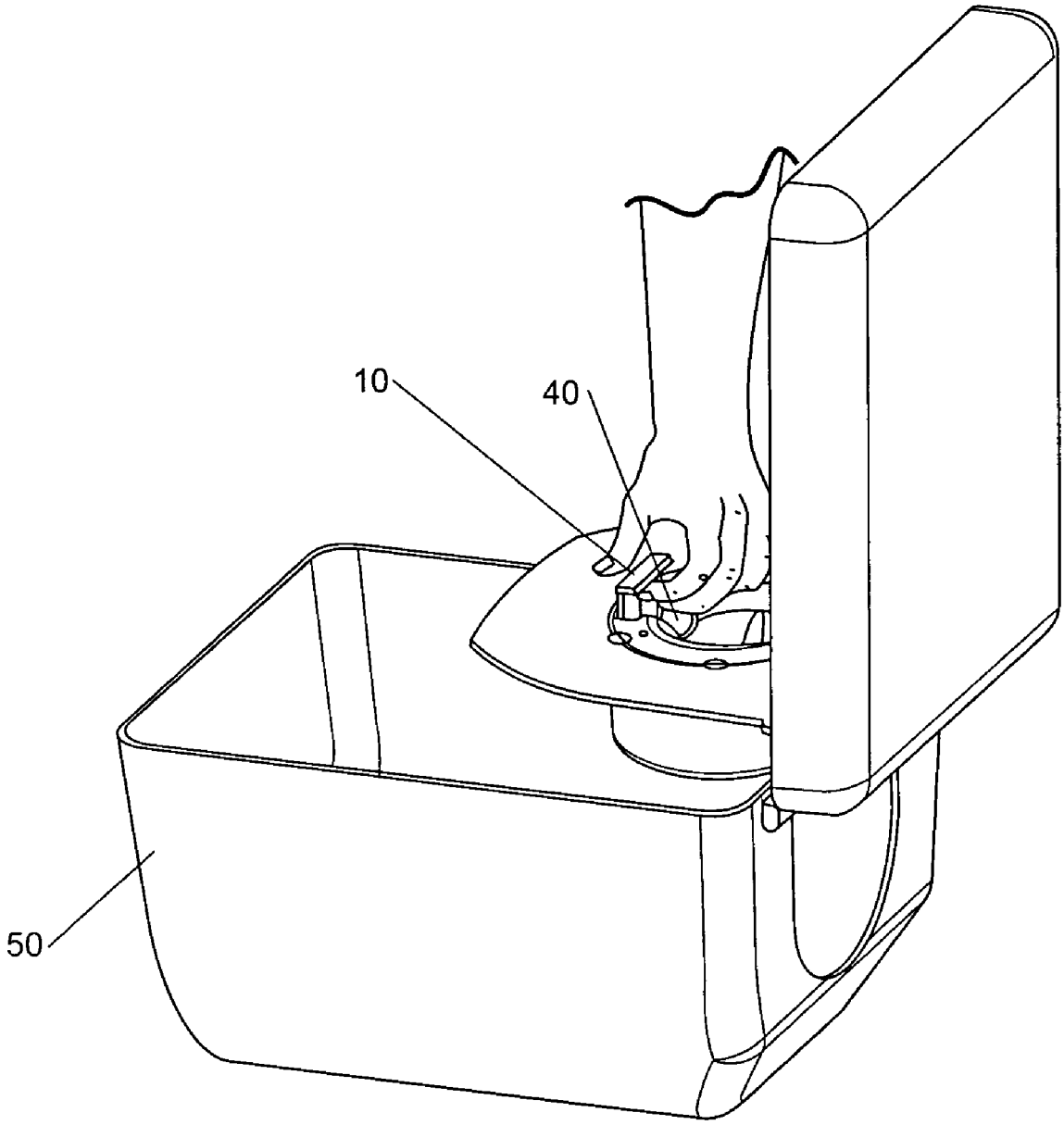
FIG. 7 illustrates the swinging down of the assembly cover 50 and the first process to introducing the paper product through the system by lifting of the actuator handle 10, accessed from the recess 40, to open the throat of the passage, FIG. 8 goes on to show the now easy procedure of feeding the paper product 18 through the system, with the throat opened.

Therefore shown in FIG. 7 is manual activation of the the present mechanism of the invention for removing the restriction controller from the passage 28 without loosing the setting that has been provided by the spindle 29. The restriction controller of the present invention can be displaced from the passage and be returned back to the passage without loosing the setting once it has been returned. FIG. 1, shows this assemblage.

This is preferably achieved by providing the restriction controller on a carrier 1. This carrier, carries the restriction controller 2 and the restriction adjustment mechanism 4. The carrier itself is displaceable relative to the passage. When it is displaced relative to the passage both the restriction controller 2 and the restriction adjustment mechanism 4 are displaced in unity. The carrier 1 is moveable between two conditions, the first where the restriction controller is operative and the other where the restriction controller is substantially removed from the passage way 28 to thereby clear the passage way to allow for more convenient feeding of tissue material.

The carrier 1 is preferably manually actuable so that a person who is re-loading a new roll into the dispenser, can actuate the carrier to move it to the second condition for convenient re-loading. The actuation mechanism is preferably provided so that the openable and closure defining member needs first to be opened before access to the actuation mechanism for the carrier can be accessed.

The dispenser of the present invention may be installed in situations where unwanted tampering of the dispenser may occur and hence precautions have been taken with the design of the product to reduce any such tampering resulting in a failure or reduced efficiency in operation of the invention. The dispenser of the present invention may for example be located in toilets of bars and where any intoxicated people have a higher disposition to vandalism.

In the most preferred form the carrier 1 is actuable at a level proximate to the supporting surface of the base 11. An actuator handle 10 is preferably graspable by a person re-loading a roll in the dispenser and can be moved preferably in a substantially vertical direction. This vertical movement is translated into a substantially horizontal movement of the carrier 1 by the use of a carrier actuator 3 which, supported by a track moves up and down, thereby displacing a pinion lug 8 which forms part of the carrier pinion 6 which is engaged with the carrier rack 5 to thereby displace the carrier 1.

When the actuator handle 10 is pulled up and out of the plane of the base 11 and handle, the restriction controller 2 is in the second condition. As soon as a feed of material has passed through the passage and the new roll is placed onto the support surface of the base 11, the actuator handle is automatically returned to be within the plane of the support surface thereby also returning the restriction controller 2 to the original position.

Figure 11:
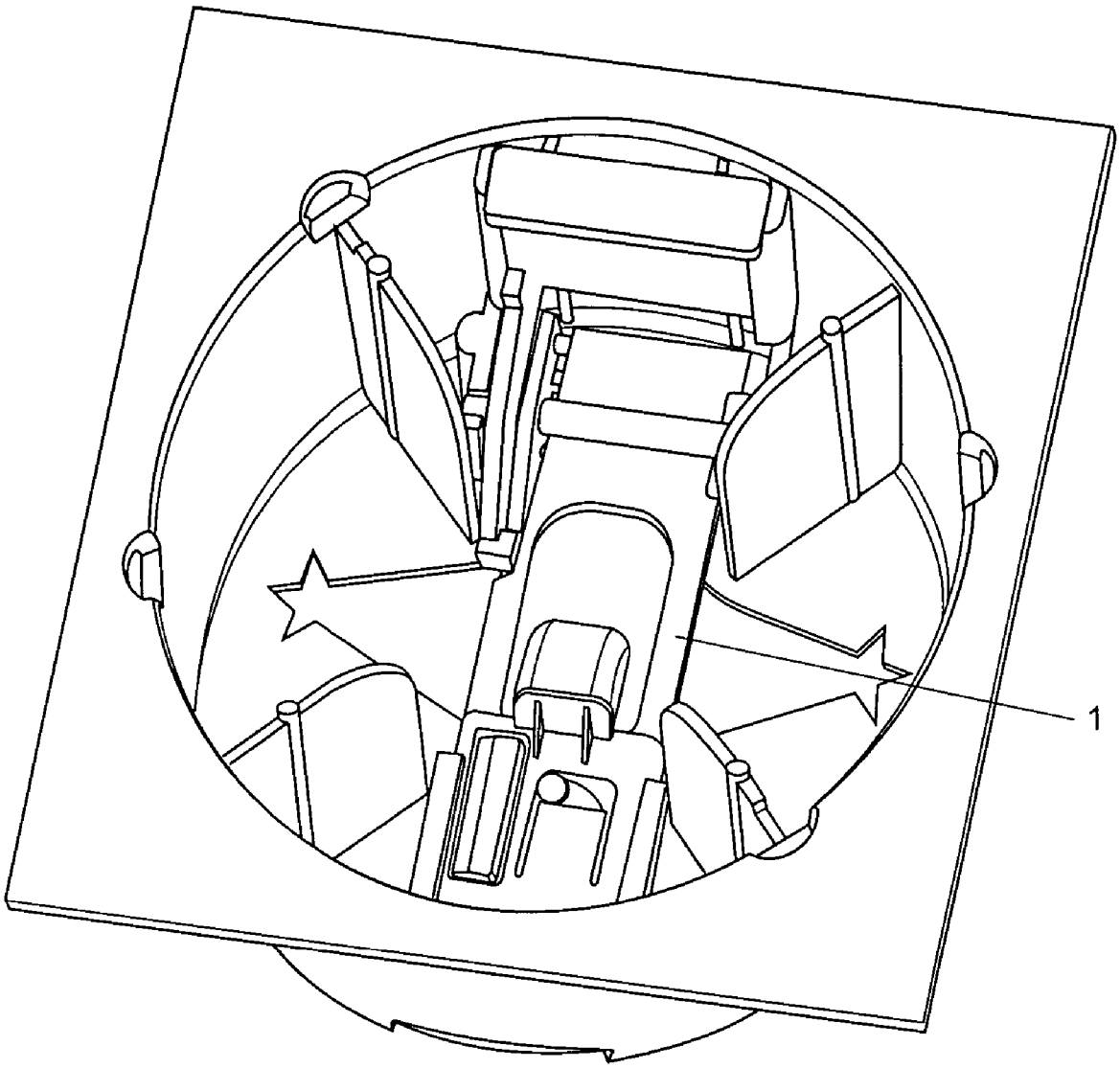
FIG. 11 is a perspective view of the base and the restriction control mechanism located therein.

FIG. 11 is a perspective view of the base 11, absent of the funnel 9 but showing the position of the restriction controller mechanism therewith. The funnel 9 has an opening 34 therein, into which the restriction controller 2 inserts.

Channels 38 may for example be provided as part of the funnel defining member 9 as shown in FIG. 4, to allow for controlled vertical movement of the carrier actuator 3.

Shown in FIG. 13 is the same apparatus as that of FIG. 2 however an alternative tensioning modification system is employed.

In the alternative or in addition to the adjustment of the throat by handle 10, is the use of a biasing means on, in this embodiment, the back surface of the restriction controller 2. The proximate end of the spring 51 bears upon the restriction controller to urge it into the throat of the funnel (not shown). In this way a constant tension is placed upon the paper towel that is passing through the throat.

The level of tension placed upon the towel is self adjusting and will alter to match the characteristics of the paper towel passing through the throat. In this way fine tuning of the tension can be avoided if such a system is desired. The distal end of the spring 51 bears upon an inner surface of the base 11 (not shown). When the mechanism is activated when installing a new core of paper, the system activates as previously described and the spring is compressed under the horizontal movement of the carrier 1 and thus the restricting mechanism 2. The spring 51 also aids in returning the system to a dispensing state (i.e within the restricting mechanism within the funnel, bearing against the paper towel).

In this embodiment the key activated adjustment mechanism previously described may remain and be utilised, for example for the settling of limits for the throw of the restriction mechanism into the throat of the funnel.

Figure 14:
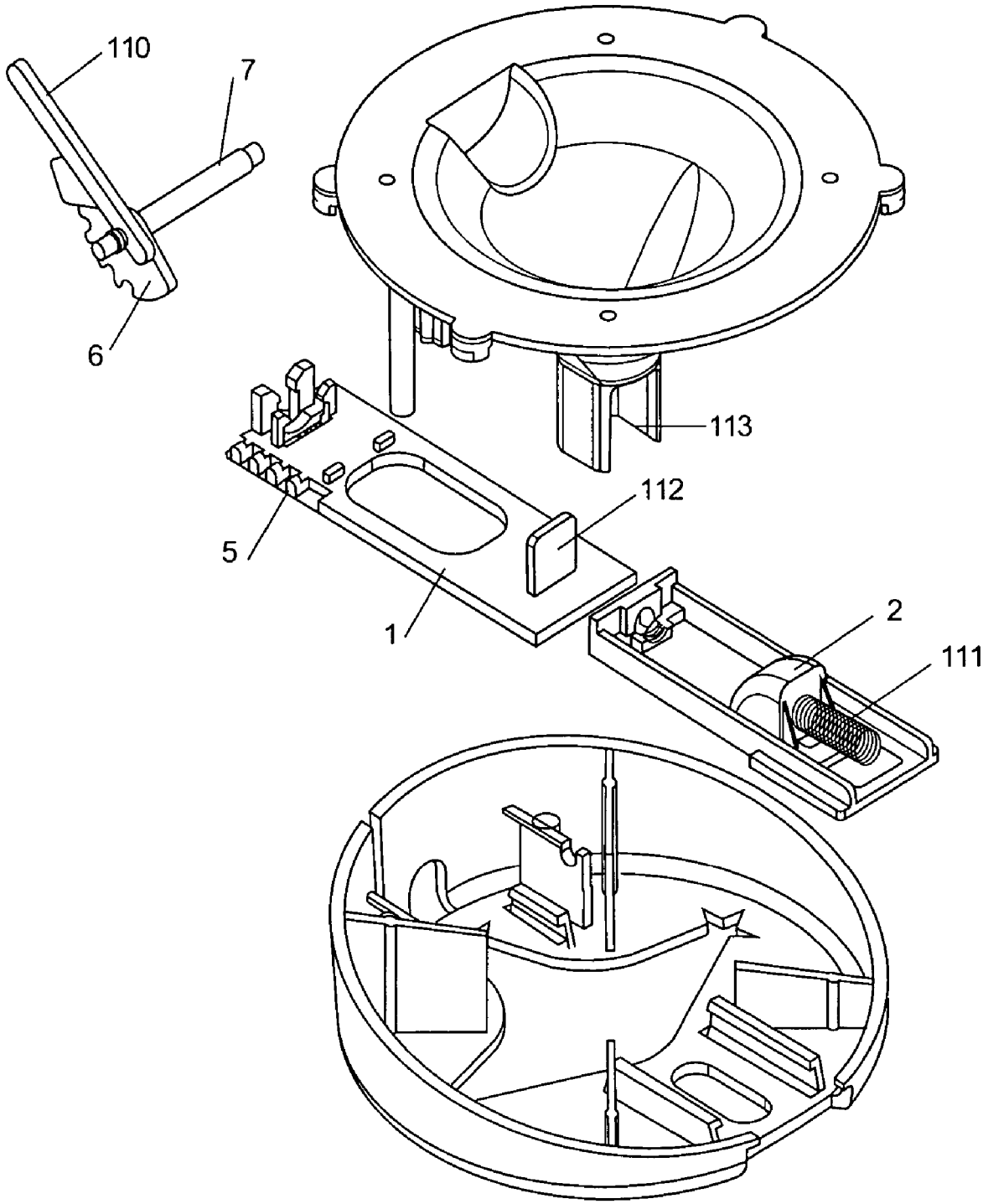
FIG. 14 is an exploded perspective view of the internal components of the dispenser of a second configuration of the components wherein a new form of actuator handle 110 is provided to actuate the movement of the carrier 1 and restriction controller 2.

With reference to FIG. 14, an alternative configuration of handle is shown for the actuation of movement of the restriction controller 2 and its carrier 1. The carrier 1 and restriction controller 2 remain of a similar kind as that shown in FIG. 10 but a spring 111 is provided for allowing the adjustment of the position of the restriction controller 2 relative to the base 1. The spring acts against a backstop 112 and is position between the backstop 112 and the restriction controller 2. The carrier pinion 6 is still provided in a manner to act on the rack 5 of the carrier 1 in a similar manner as that shown in FIG. 10. However instead of the provision of the handle 10 to actuate the pinion 6, a handle 110 is provided which can control the rotation of the pinion about its rotational axis 7.

Figure 15:
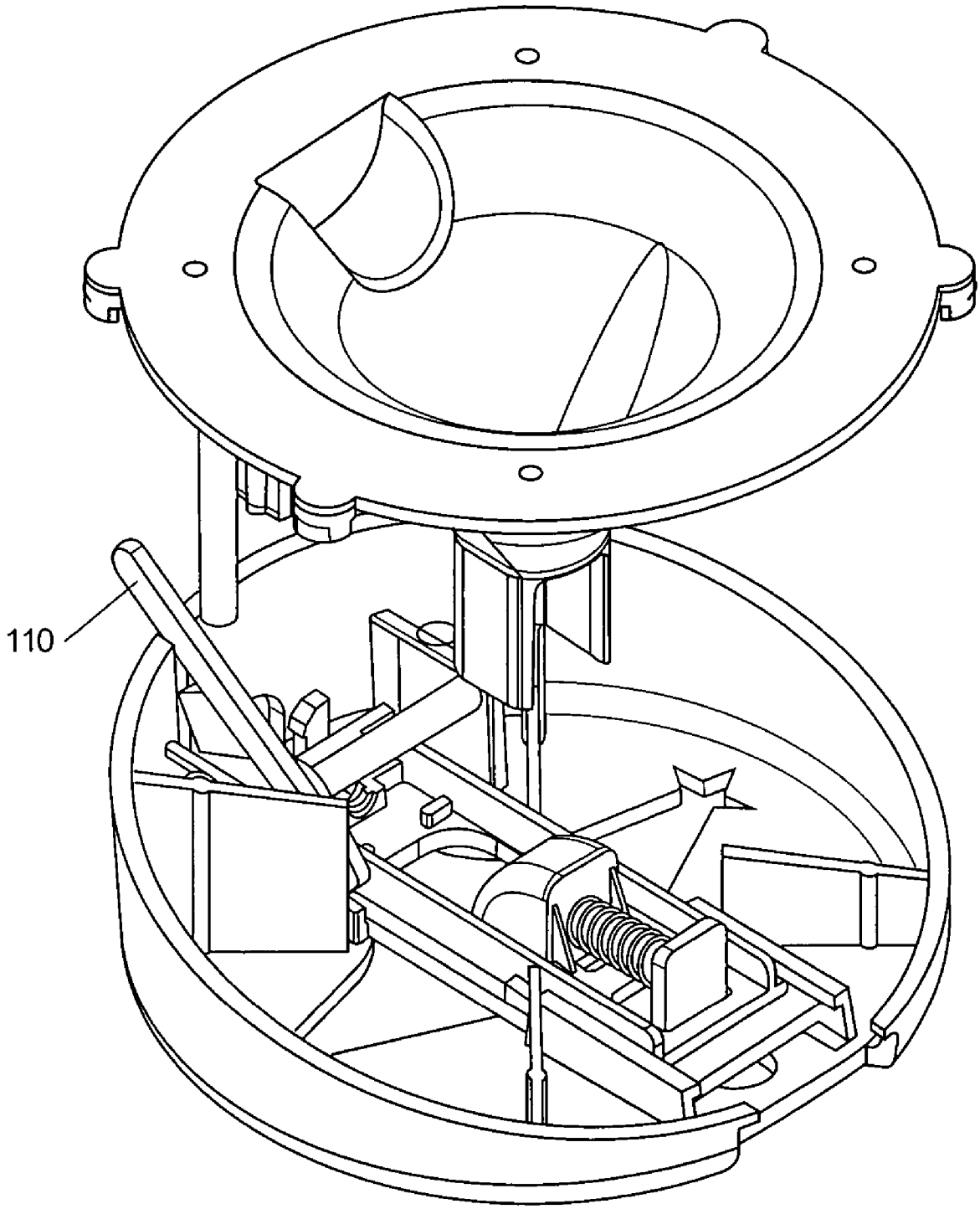
FIG. 15 is an assembled view of FIG. 14 and wherein the handle 110 is shown in a first condition.
Figure 16:
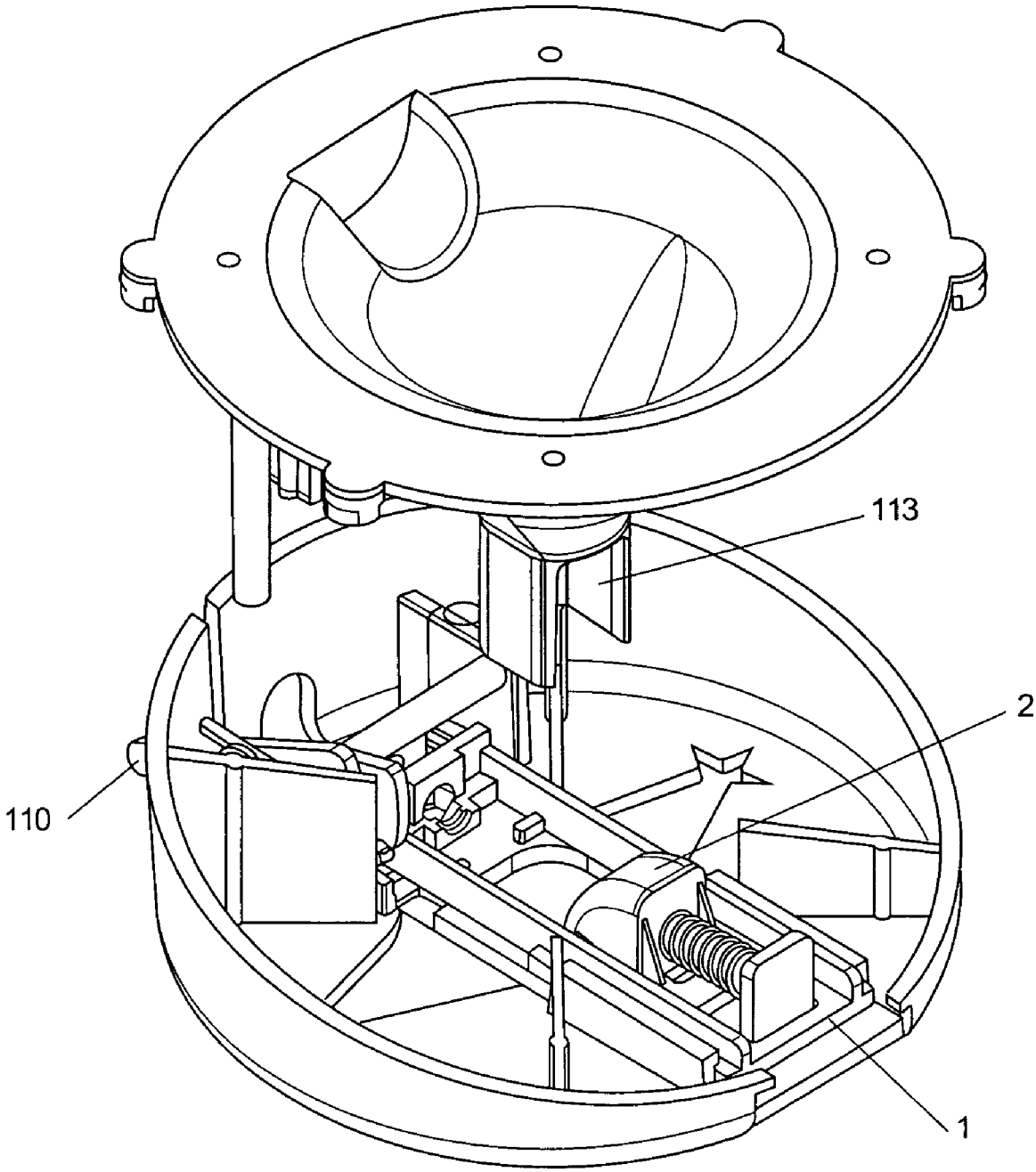
FIG. 16 is an assembled view of the components of FIG. 14 wherein the handle 10 is shown in a second condition.

The handle 110 is a handle in this configuration of the invention actuated by the movement of the cover 50 of the dispenser relative to the wall mounting base of the enclosure of the dispenser. With reference to FIG. 8, it can be seen that the cover 50 is able to rotate relative to the wall mounting base of the enclosure for the dispenser about a horizontal axis. The axis is provided towards the bottom region of the enclosure and the cover is rotated outwardly and downwardly from the wall mounted base to achieve an open condition exposing the interior of the dispenser. Such exposure allows for the loading or unloading of tissue from the dispenser. When the closure is in the opened condition as for example shown in FIG. 8, it is desirable for the throat of the dispensing opening to be opened thereby allowing for convenient loading of tissue through the throat. Such opening is achieved by the movement of the restriction controller 2 being moved in a direction creating a larger opening. With reference to FIG. 16, such a condition is shown where the carrier 1 and the restriction controller 2 have been moved to enlarge the throat 113. In this loading condition, the handle 110 has been rotated downwardly. In the operative condition where the throat has been more restricted by the restriction controller 2 and for example as shown in FIG. 15, the handle has been rotated upwardly. This brings the restriction controller into a more restricted condition of the throat 113.

Figure 9:
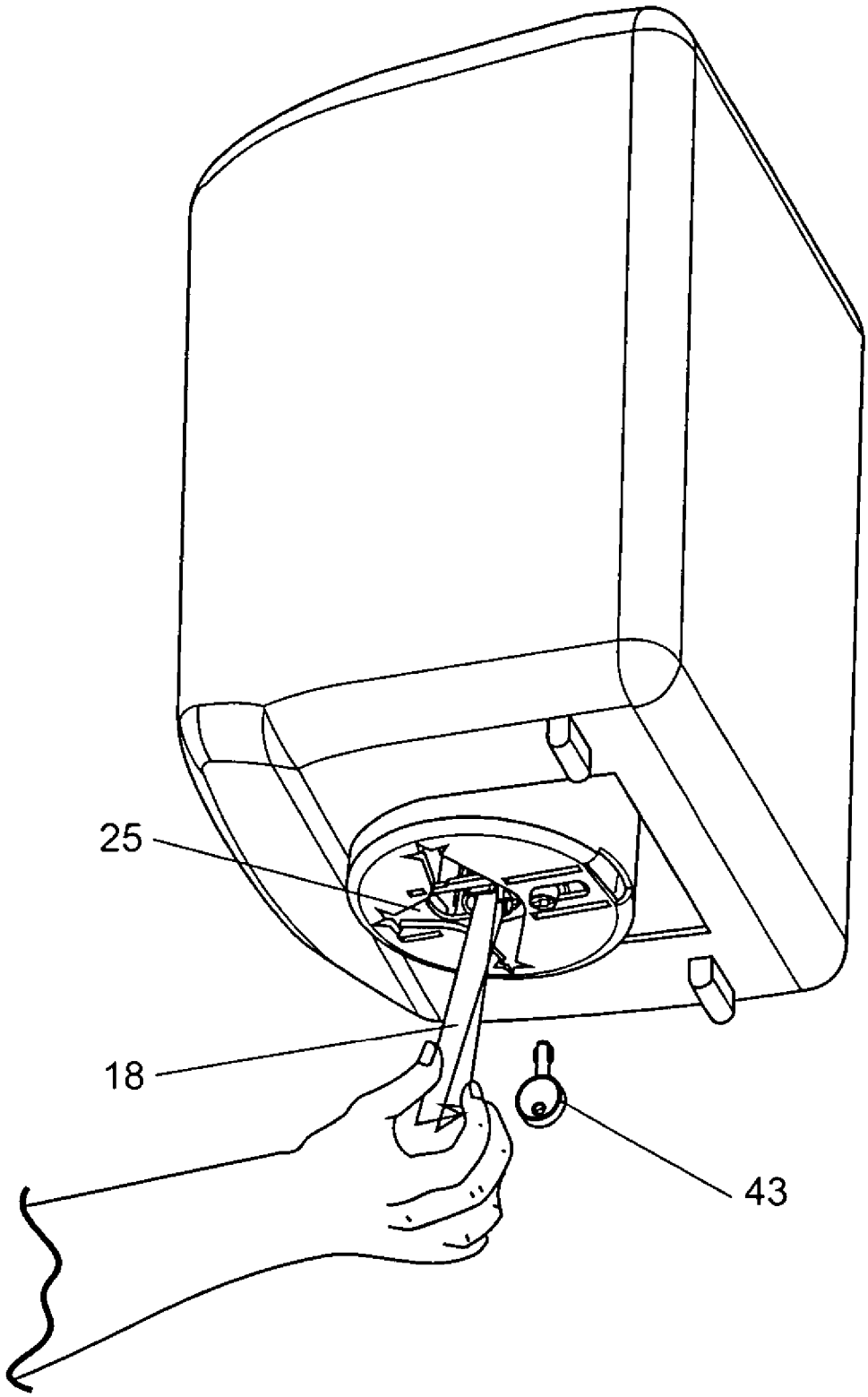
FIG. 9 illustrates the final part of the procedure, once the assembly cover has been swung back into place, where the key 43 is used to adjust the position of the restriction controller in the throat of the passage to apply the correct amount of friction to the paper to facilitate easy withdrawal through the funnel, of the paper and its subsequent tearing off of the desired portion aided by the region 25.

The actuation of the handle 110 is achieved by it interacting with the cover 50. When the cover is rotated from the opened condition as shown in FIG. 8 to the closed condition as shown in FIG. 9, a portion of the cover interacts with the handle 110 and moves it from the downward position as shown in FIG. 16 to the upward position as shown in FIG. 15. Movement of the cover from the closed condition to the opened condition results in part of the cover interacting with the handle 110 to move it from the upwardly rotated condition as shown in FIG. 15 to the downwardly rotated condition in FIG. 16. Accordingly the positioning of the restriction controller 2 between the operative mode as shown in FIG. 15 and the loading mode as shown in FIG. 16 occurs simultaneous with the operative condition of the relationship of the covers and the loading condition of the covers.

In this configuration a fine tuning key may still be used to adjust the setting of the restriction controller 2 when in the operative condition as shown in FIG. 15. However since in this configuration of the invention the restriction controller 2 as dependent from its carrier 1 now moves merely between two conditions relative to the throat 113, no adjustment like that provided by the handle 110 is to be provided. Active adjustment of the restriction controller 2 is now achieved during the various phases of dispensing of the tissue from the roll of the restriction to the throat by the restriction controller 2 as a result of the spring 111. It has been found by the inventor that a spring with particular characteristics is able to achieve a control of the restriction to the throat 113 when the device is in the operative condition as shown in FIG. 15 where the restriction controller 2 is capable of adjusting its position relative to the throat in a manner to allow for reliable dispensing of tissue to occur. Once the cover is closed and the mechanism is in the condition as shown in FIG. 15, adjustment of the restriction controller 2 is an active adjustment and is determined by the spring 111. It has been found that a helical spring of a spring constant 0.732 N/mm is a suitable spring which will ensure that there is pressure when in the operative condition to bias the restriction means to the restricted most side of the throat. When in the operative mode, the restriction means 2 will move with any varying characteristics of the paper away from its throat restricting most condition towards the back stop 112 by compressing the spring 111. The bias the spring provides to the restriction means 2 encourages the restriction means to sty in the throat restricting most condition set by carrier 1 when moved to the operative condition by the movement of the handle 110.

I claim:

1. A center pull tissue dispenser comprising means defining an openable enclosure, a base member located within said enclosure with which a coreless roll of towel material is to be located in an upward supporting manner in a maimer such that an end face of said roll is placed therewith, said base member including a dispensing opening for said towel material to pass through, an opening is provided in alignment with said dispensing opening, through said openable enclosure defining member, to allow said towel material to be dispensed from said dispenser, wherein downstream of the support of said roll by said base member there is provided a dispensing characteristic adjustment mechanism which includes, a passageway through which said towel material is to pass, and a passageway restriction controlling member, with relative movement to said passageway in a direction lateral to the direction of the passing of said paper towel material there through and penetrating into the passageway to act on said paper towel material during the dispensing thereof from said dispenser, said relative movement being controlled by a spindle rotatable about an axis transverse to the direction of said relative movement and having a lug off-set from said axis, mechanically coupled with said restriction controlling member to displace said restriction controlling member relative to said passageway.

2. The center pull tissue dispenser as claimed in claim 1, wherein said passageway restriction controlling member is mounted on a carrier relative to which it is movable by said spindle to variably restrict the passing of paper towel material through said passageway.

3. The center pull tissue dispenser as claimed in claim 2, wherein said carrier is itself movable and when moved, said restriction controlling member displaces in unity there with.

4. The center pull tissue dispenser as claimed in claim 2, wherein when said carrier is moved, the restriction of said passageway is changed.

5. The center pull tissue dispenser as claimed in claim 1, wherein said restriction controlling member can be moved entirely out of said passageway.

6. The center pull tissue dispenser as claimed in claim 2, wherein said restriction controlling member is moveable relative to said carrier by being in a sliding engagement with said carrier.

7. The center pull tissue dispenser as claimed in claim 1, wherein said passageway restriction controlling member is adjustable in its positioning relative to said passageway from outside of said openable enclosure.

8. The center pull tissue dispenser as claimed in claim 1, wherein said passageway restriction controlling member is adjustable by a key which is insertable into a keyhole to operate a mechanism to displace the passageway restriction controlling member relative to said passageway.

9. The center pull tissue dispenser as claimed in claim 1, wherein the restriction controlling member is moveable relative to said passageway and urged toward a passage way restricting condition by a biasing means to restrict said passageway.

10. The center pull tissue dispenser as claimed in claim 2, wherein said carrier is manually movable by operation of a handle which controls a carrier movement actuator mechanism.

11. The center pull tissue dispenser as claimed in claim 1, wherein a funnel member is provided below the support surface of said base member to funnel and guide towel material in a continuous manner from the coreless roll towards said opening in a openable enclosure.

12. The center pull tissue dispenser as claimed in claim 1, wherein said towel is to be dispensed from the center outwardly of said coreless roll.

13. The center pull tissue dispenser as claimed in claim 1, wherein said dispensing characteristic adjustment mechanism is provided downstream of said support surface of said base, and within said enclosure of the dispenser.

14. The center pull tissue dispenser as claimed in claim 1, wherein said openable enclosure is openable in a manner to allow access to said base member.

15. The center pull tissue dispenser as claimed in claim 1, wherein said openable enclosure consists of a back wall mountable portion for mounting to a substantially vertical surface of a structure, and a cover moveable relative thereto.

16. The center pull tissue dispenser as claimed in claim 15, wherein said cover is pivotally moveable relative to said back wall mountable portion.

17. The center pull tissue dispenser as claimed in claim 1, wherein said openable enclosure consist of a first cover member pivotally located with a second cover member movable relative to each other between an open condition wherein said interior of said openable enclosure is exposed and a closed condition wherein said interior is closed, said dispensing characteristic adjustment mechanism actuated by the movement of said first cover member with said second cover member by an actuator in mechanical engagement with a said first or second cover member and coupled to said passageway restriction controlling member to move it from a first position relative to said passage way when the enclosure is in said open condition to a passageway restricting more condition when said enclosure in said closed condition.

18. The center pull tissue dispenser as claimed in claim 1, wherein said passageway restriction controlling member is mounted on a carrier relative to which it is movable to variably restrict the passing of paper towel material through said passageway and said openable enclosure consist of a first cover member pivotally located with a second cover member movable relative to each other between an open condition wherein said interior of said openable enclosure is exposed and a closed condition wherein said interior is closed, said dispensing characteristic adjustment mechanism actuated by the movement of said first cover member with said second cover member by an actuator in mechanical engagement with a said first or second cover member and coupled to said carrier to move it from a first position relative to said passage way when the enclosure is in said open condition to a second condition when said enclosure in said closed condition wherein the passageway restriction controlling member is in a passageway restricting more condition.

19. The center pull tissue dispenser as claimed in claim 18, wherein said actuator moves said carrier between two conditions, wherein in one such condition, corresponding to the enclosure being in a closed condition, placing said passageway restriction controlling member in said passageway, wherein said passageway restriction controlling member is slidably disposed from said carrier in a direction lateral to said passageway direction, a biasing means acting on said passageway restriction controlling member from said carrier to urge said passageway restriction controlling member to a passageway restricting more condition yet allowing the displacement of said passageway restriction controlling member in a direction opposite thereto against the biasing force.

20. The center pull tissue dispenser as claimed in claim 18, wherein said first cover member and said second cover member are pivotally engaged about a pivot axis extending lateral to the passageway direction.

21. The center pull tissue dispenser as claimed in claim 18, wherein said pivot axis is provided such that the second cover moves downwardly to said first cover in moving from the second condition to the first condition.

22. A mechanism to control the dispensing characteristics of a towel from a dispenser comprising:

a base member to be placed inside a dispenser for receiving thereon or therewith a coreless roll of towel in a manner such that an axial end face of said roll is placed thereagainst, wherein downstream of the support of said roll by said base member there is provided a dispensing characteristic adjustment mechanism which includes, a passageway through which said towel material is to pass, and a passageway restriction controlling member movable relative to said passageway in a direction lateral to the direction of the passing of said paper towel material there through and penetrating into the passageway to act on said paper towel material during the dispensing thereof from said dispenser, said relative movement being controlled by a spindle rotatable about an axis transverse to the direction of said relative movement and having a lug off-set from said axis, mechanically coupled with said restriction controlling member to displace said restriction controlling member relative to said passageway.

* * * * *